US008428294B2

(12) United States Patent
Liu

(10) Patent No.: US 8,428,294 B2
(45) Date of Patent: Apr. 23, 2013

(54) SLIM SPEAKER

(76) Inventor: Chun I Liu, Taoyuan (TW)

( * ) Notice: Subject to any disclaimer, the term of this patent is extended or adjusted under 35 U.S.C. 154(b) by 148 days.

(21) Appl. No.: 12/917,502

(22) Filed: Nov. 2, 2010

(65) Prior Publication Data

US 2012/0106776 A1 May 3, 2012

(51) Int. Cl.
*H04R 25/00* (2006.01)

(52) U.S. Cl.
USPC ..... 381/398; 381/404; 381/420; 381/423

(58) Field of Classification Search ..... 381/398, 381/403, 404, 396, 412, 420, 430–433, 423
See application file for complete search history.

(56) References Cited

U.S. PATENT DOCUMENTS 6,236,733 B1 * 5/2001 Kato et al. ..... 381/423
7,185,735 B2 * 3/2007 Sahyoun ..... 181/157
7,203,333 B2 * 4/2007 Funahashi et al. ..... 381/403
7,225,895 B2 * 6/2007 Sahyoun ..... 181/157
7,236,607 B2 * 6/2007 D'Hoogh ..... 381/396
7,433,485 B1 * 10/2008 Diedrich et al. ..... 381/404
8,045,745 B2 * 10/2011 Horigome et al. ..... 381/398
2004/0076309 A1 * 4/2004 Sahyoun ..... 381/412
2010/0208934 A1 * 8/2010 Dohi et al. ..... 381/398

* cited by examiner

*Primary Examiner* — Davetta W Goins
*Assistant Examiner* — Phylesha Dabney
(74) *Attorney, Agent, or Firm* — Jackson IPG PLLC

(57) ABSTRACT

A slim speaker includes a casing having an enlarged front opening and a rear end with a magnetic circuit mounted thereto; a voice coil located over a central area of the magnetic circuit; a diaphragm located between the enlarged front opening of the casing and the voice coil; and a damper located behind the diaphragm to space from the latter. The diaphragm has at least one V-shaped bent section provided at a middle portion for bearing on a corresponding position on the damper. With these arrangements, the diaphragm not only has an effectively reduced overall height to largely reduce the assembled volume of the slim speaker and allow the slim speaker to be easily mounted in the limited inner space of an electric product, but also stabilizes the vibration of the voice coil to enable good resonance of sound.

3 Claims, 4 Drawing Sheets

SLIM SPEAKER

FIELD OF THE INVENTION

The present invention relates to a slim speaker, and more particularly to a slim speaker that not only has simplified structure to effectively reduce an overall height of the diaphragm thereof and an assembled volume of the whole speaker for easily mounting in the limited inner space of an electric product, but also stabilizes the vibration of the voice coil of the speaker to enable good resonance of sound.

BACKGROUND OF THE INVENTION

The rapid progress in scientific and technological fields brings people upgraded living quality. For instance, the conventional large-sized and expensive cathode ray tube (CRT) television has been replaced by the low-weight and slim liquid crystal display (LCD) television. The LCD television is able to provide ideal-quality, high-fidelity and large-size images, and allows users to enjoy virtual live visual pleasure. Further, in practical use thereof, the LCD television occupies less space and can be positioned on a low cabinet or hung on a wall in a living room, and is therefore widely accepted by the consumers.

The new-generation LCD television is featured by its large-size screen and small thickness, and looks just like a simple and orderly picture frame. However, due to the reduced overall thickness and volume, the LCD television now has very limited inner space. FIG. 1 is an assembled sectional view of conventional speaker for television. As shown, the conventional speaker has a casing with an enlarged front opening and a magnetic circuit mounted to a rear end thereof. A voice coil is located at a central area of the magnetic circuit. A diaphragm is provided between and glued to the enlarged front opening of the casing and the voice coil. A damper is provided behind the diaphragm to space therefrom. While the conventional speaker produces good sound quality, it has a relatively large volume and is therefore not suitable for mounting in the LCD television that has very limited inner space. In the case the speaker is reduced in size in order to be mounted in the LCD television, it would not be able to effectively resound the output sound wave to produce ideal sound effect. That is, the existing LCD television has the drawback of failing to provide a user with visual and aural pleasure at the same time.

SUMMARY OF THE INVENTION

A primary object of the present invention is to provide a slim speaker that includes a casing having an enlarged front opening and a rear end with a magnetic circuit mounted thereto; a voice coil located over a central area of the magnetic circuit; a diaphragm located between the enlarged front opening of the casing and the voice coil; and a damper located behind the diaphragm to space from the latter. The diaphragm has at least one V-shaped bent section provided at a middle portion for bearing on a corresponding position on the damper. With these arrangements, the diaphragm not only has an effectively reduced overall height to largely reduce the assembled volume of the slim speaker and allow the slim speaker to be easily mounted in the limited inner space of an electric product, but also stabilizes the vibration of the voice coil to enable good resonance of sound.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
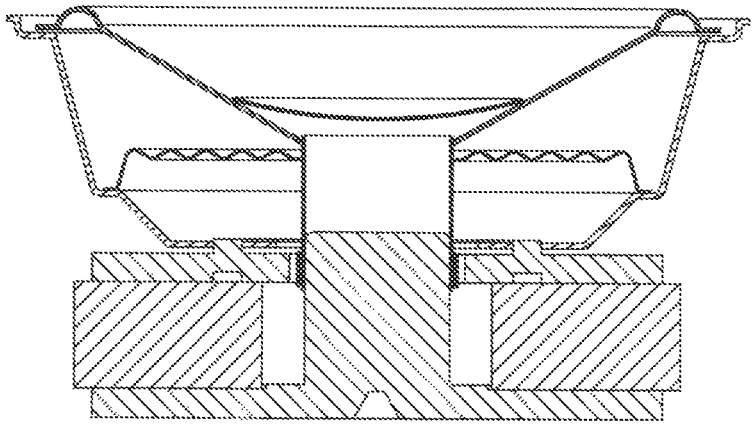
FIG. 1 Prior Art
FIG. 1 is an assembled sectional view of a conventional diaphragm speaker.

The present invention will now be described with some preferred embodiments thereof. For the purpose of easy to understand, elements that are the same in the preferred embodiments are denoted by the same reference numerals.

Figure 2:
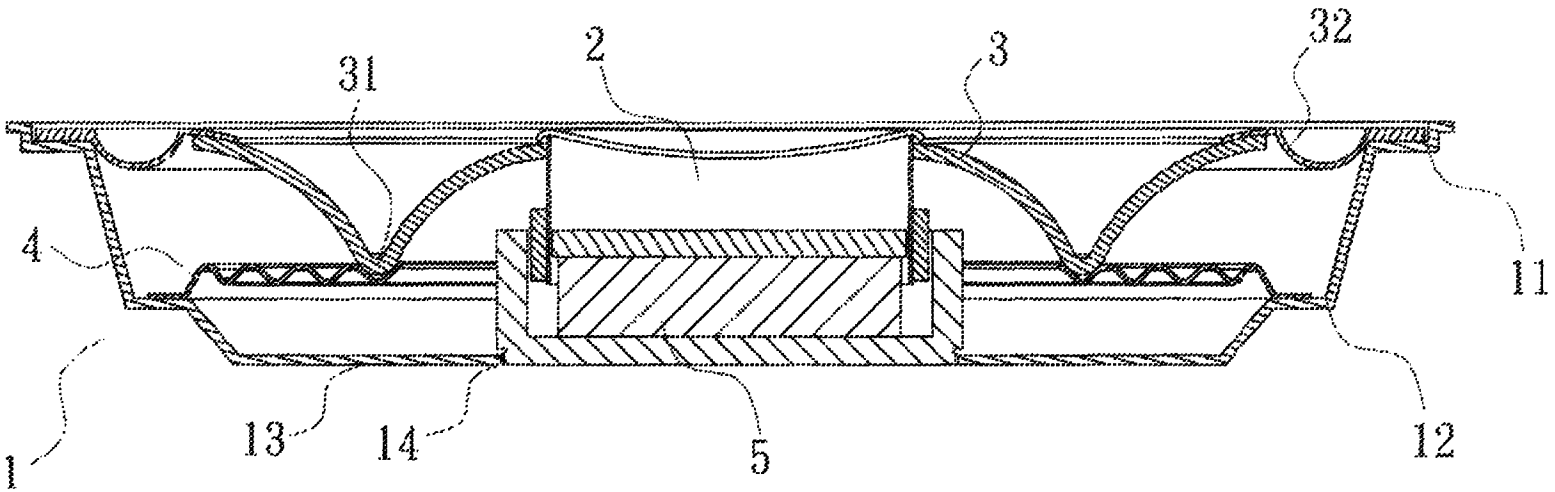
FIG. 2 is an assembled sectional view of a slim speaker according to a first embodiment of the present invention.

Please refer to FIG. 2 that is an assembled sectional view of a slim speaker according to a first embodiment of the present invention. As shown, the slim speaker in the first embodiment includes a casing 1 having an enlarged front opening 11 and a rear end with a magnetic circuit 5 mounted thereto; a voice coil 2 fitted over a central area of the magnetic circuit 5; a diaphragm 3 located between the enlarged front opening 11 of the casing 1 and the voice coil 2; and a damper 4 located behind the diaphragm 3. In practical implementation, the casing 1 can be a shallow dish-like member having a stepped peripheral wall 12 and a size-reduced flat bottom 13. The stepped peripheral wall 12 internally defines a shoulder portion. The size-reduced flat bottom 13 is connected to the stepped peripheral wall 12 and is provided with a central opening 14 for correspondingly receiving the magnetic circuit 5 therein.

The slim speaker of the present invention is characterized in that the diaphragm 3 is provided at a middle portion with at least one V-shaped bent section 31 for bearing on a corresponding position on the damper 4. In practical implementation, the damper 4 has an outer circumferential edge glued to the shoulder portion of the stepped peripheral wall 12 of the casing 1 and an inner circumferential edge glued to a bottom of the bent section 31 of the diaphragm 3. Alternatively, in a second embodiment of the present invention as shown in FIG. 3, the damper 4 is formed along the inner circumferential edge with a forward extended conical tube 41 for fitting around and gluing to the voice coil 2.

Figure 3:
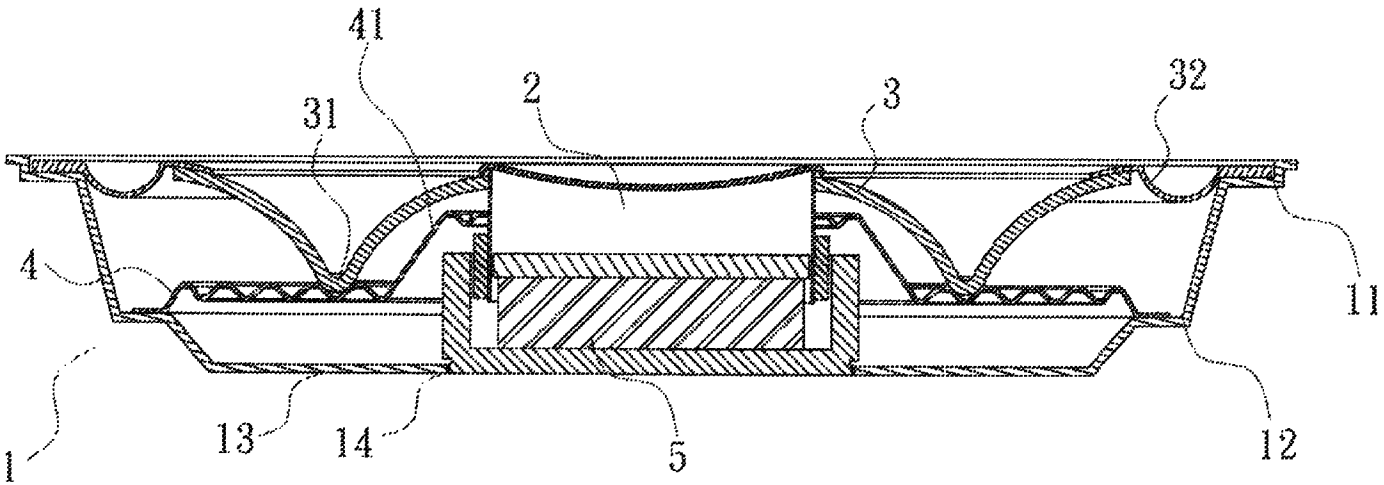
FIG. 3 is an assembled sectional view of a slim speaker according to a second embodiment of the present invention.
Figure 4:
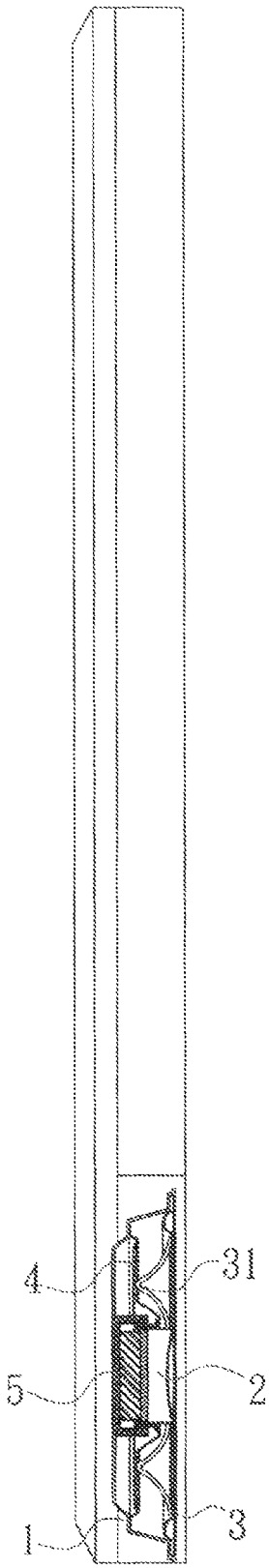
FIG. 4 shows the mounting of the slim speaker of the present invention in an LCD television.

Please refer to FIGS. 2 to 4 at the same time. To assemble the slim speaker of the present invention, first fit the magnetic circuit 5 in the opening 14, so that the magnetic circuit 5 is located on an inner side of the flat bottom 13 of the casing 1; dispose the voice coil 2 over a central area of the magnetic circuit 5; glue the outer circumferential edge of the damper 4 to the shoulder portion in the stepped peripheral wall 12 of the casing 1; glue the inner circumferential edge of the damper 4 to the bent section 31 of the diaphragm 3 or to the voice coil 2; align a central hole of the diaphragm 3 with the voice coil 2 and then glue the diaphragm 3 to the voice coil 2 with the V-shaped bent section 31 glued to a corresponding position on the damper 4; finally, connect the diaphragm 3 to the enlarged front opening 11 of the casing 1 via a yoke 32.

With the above design, the diaphragm 3 and accordingly the casing 1 can have an effectively reduced overall height to thereby largely reduce the volume of the fully assembled speaker, allowing the slim speaker to be easily mounted in the very limited inner space of an LCD television, as shown in FIG. 4, or other electric products that have more and more compact and reduced volume.

In the fully assembled slim speaker of the present invention, the V-shaped bent section 31 at the middle portion of the diaphragm 3 is glued to a corresponding position on the damper 4. When the slim speaker outputs sound, the diaphragm 3 presents good compliance and flexibility to bend and vibrate in response to the back and forth movement or piston motion of the voice coil 2, so that the voice coil 2 can vibrate stably for the diaphragm 3 to produce good resonance of sound. This allows the slim speaker to work and produce sound wave harmoniously to thereby obtain improved tone.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A slim speaker, comprising:

a casing having an enlarged front opening and a rear end with a magnetic circuit mounted thereto;

a voice coil being fitted over a central area of the magnetic circuit;

a diaphragm being located between the enlarged front opening of the casing and the voice coil; and a damper being located behind the diaphragm to space from the latter;

wherein the damper has an inner circumferential edge directly attached to the voice coil;

wherein the diaphragm is characterized by having at least one V-shaped bent section provided at a middle portion thereof attached to a corresponding position on the damper;

wherein one end of the diaphragm is attached to the enlarged front opening of the casing and another end of the diaphragm is directly attached to the voice coil, separately from and at a different position than the damper; and whereby the diaphragm has an effectively reduced overall height to largely reduce a volume of the slim speaker in a fully assembled state, and to stabilize a vibration of the voice coil for producing good resonance of sound;

wherein the casing is a shallow dish-like member having a stepped peripheral wall to internally define a shoulder portion, the size reduced flat bottom being connected to the stepped peripheral wall;

wherein the diaphragm is connected to the enlarged front opening of the casing via a yoke, and a bottom surface of the magnetic circuit is fitted in a central opening of the flat bottom of the casing so that the bottom surface of the magnetic circuit is flush with the flat bottom of the casing and, when the magnetic circuit is installed, the entire bottom surface of the slim speaker is flat from one stepped peripheral wall to the other stepped peripheral wall.

2. The slim speaker as claimed in claim 1, wherein the damper has an outer circumferential edge being glued to the shoulder portion of the stepped peripheral wall of the casing and an inner circumferential edge being glued to a bottom of the V-shaped bent section of the diaphragm.

3. The slim speaker as claimed in claim 1, wherein the damper has an outer circumferential edge being glued to the shoulder portion of the stepped peripheral wall of the casing and an inner circumferential edge extending inwards and upwards toward both the voice coil and a front of the speaker and fitted around and directly attached to the voice coil.

* * * * *